US007027013B2

(12) United States Patent
Ouellette et al.

(10) Patent No.: US 7,027,013 B2
(45) Date of Patent: Apr. 11, 2006

(54) SHARED PIXEL ELECTROLUMINESCENT DISPLAY DRIVER SYSTEM

(75) Inventors: Kirk Ouellette, Hamilton (CA); Chung-Fai Cheng, New Market (CA); Don Carkner, Toronto (CA); Eiric Johnstone, Mississauga (CA); Xingwei Wu, Brampton (CA); James Stiles, Edmonton (CA)

(73) Assignee: Ifire Technology, Inc., Fort Saskatchewan (CA)

( * ) Notice: Subject to any disclaimer, the term of this patent is extended or adjusted under 35 U.S.C. 154(b) by 373 days.

(21) Appl. No.: 09/747,464

(22) Filed: Dec. 22, 2000

(65) Prior Publication Data

US 2002/0126074 A1 Sep. 12, 2002

(51) Int. Cl.
*G09G 3/30* (2006.01)

(52) U.S. Cl. ..... 345/76; 345/36; 345/55; 345/98; 345/694; 345/696

(58) Field of Classification Search ..... 345/50, 345/55, 87, 88, 98, 696, 694, 76, 36; 348/792
See application file for complete search history.

(56) References Cited

U.S. PATENT DOCUMENTS 4,822,142 A 4/1989 Yasui
4,847,609 A 7/1989 Kuwata et al.
5,517,207 A 5/1996 Kawada et al.
5,748,276 A * 5/1998 Uno et al. ..... 349/144
5,856,813 A 1/1999 Katayama et al.
6,034,481 A 3/2000 Haynes
6,104,365 A * 8/2000 Towler et al. ..... 345/89
6,121,961 A * 9/2000 Feldman ..... 345/204
6,201,545 B1 * 3/2001 Wong et al. ..... 345/428
6,252,613 B1 * 6/2001 Borel et al. ..... 345/531
6,271,820 B1 * 8/2001 Bock et al. ..... 345/97
6,417,868 B1 * 7/2002 Bock et al. ..... 345/698

FOREIGN PATENT DOCUMENTS

EP 0 428 324 A2 5/1991
WO WO 97 23861 A 7/1997

* cited by examiner

*Primary Examiner*—Vijay Shankar
*Assistant Examiner*—Leonid Shapiro
(74) *Attorney, Agent, or Firm*—Fay, Sharpe, Fagan, Minnich & McKee, LLP

(57) ABSTRACT

An electroluminescent display and driving method is provided wherein the rows of pixels are divided into sub-pixel sets and several different sets of sub-pixels are then addressed from within a larger superset of adjacent sub-pixels. The image data for the addressed sub-pixels is averaged with that for adjacent sub-pixels and is applied to the reduced number of larger sub-pixels in sequence. Consequently, for a given sequence of input frame data sets the time average over one frame for a portion of the sub-pixels at any location of the panel is substantially the same as that for a conventionally addressed sub-pixel in a prior art panel.

5 Claims, 7 Drawing Sheets

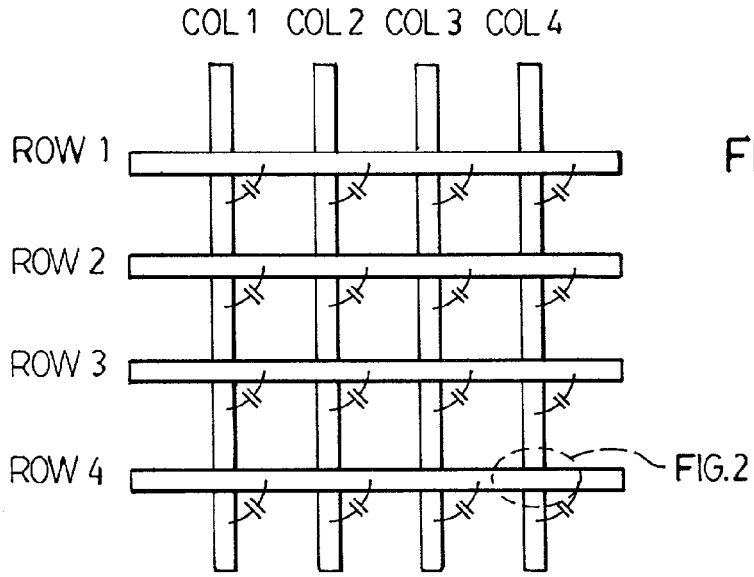
FIG.1
FIG.2
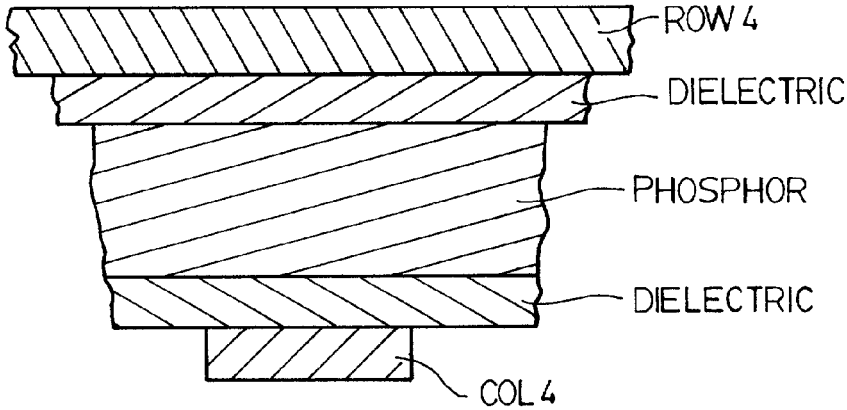
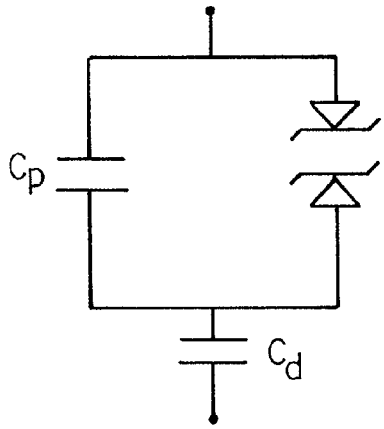
FIG.3

EVEN FIELD

ODD FIELD

SHARED PIXEL ELECTROLUMINESCENT DISPLAY DRIVER SYSTEM

FIELD OF THE INVENTION

The present invention relates generally to flat panel displays, and more particularly to a method of shared addressing of row pixels in a flat panel display for the purpose of increasing the luminance and energy efficiency of the display panel or alternatively increasing the apparent spatial resolution of the panel.

BRIEF DESCRIPTION OF THE DRAWINGS

The Background of the Invention and Detailed Description of the Preferred Embodiment are set forth herein below with reference to the following drawings, in which:

FIG. 1 is a plan view of an arrangement of rows and columns of pixels on an electroluminescent display, in accordance with the Prior Art;

FIG. 2 is a cross section through a single pixel of the electroluminescent display of FIG. 1;

FIG. 3 is an equivalent circuit for the pixel of FIG. 2;

BACKGROUND OF THE INVENTION

Figure 4A:
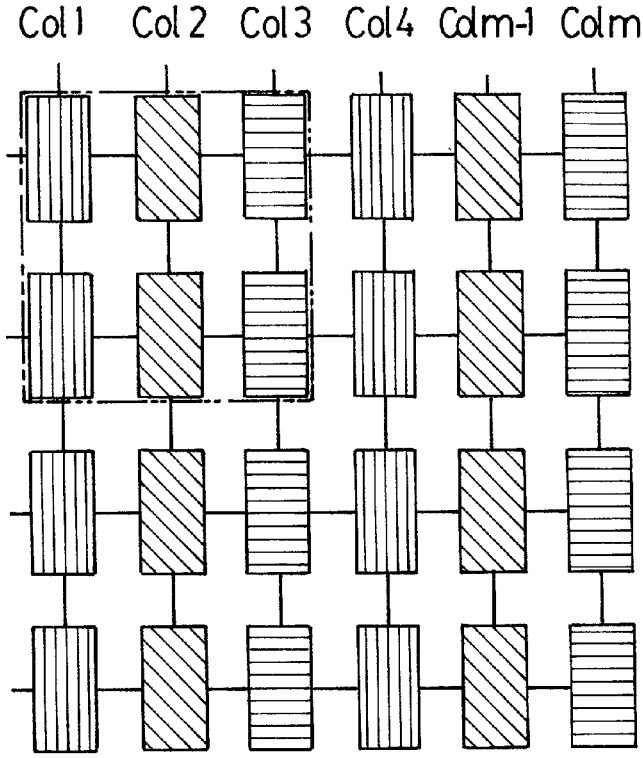
FIG. 4 comprises FIGS. 4*a* and 4*b* and is a schematic illustration of sub-frame pixel selections according to a first embodiment of the inventive pixel addressing method.

Electroluminescent displays are advantageous by virtue of their low operating voltage with respect to cathode ray tubes, their superior image quality, wide viewing angle and fast response time over liquid crystal displays, and their superior gray scale capability and thinner profile than plasma display panels.

As shown in FIGS. 1 and 2, an electroluminescent display has two intersecting sets of parallel electrically conductive address lines called rows (ROW 1, ROW 2, etc.) and columns (COL 1, COL 2, etc.) that are disposed on either side of a phosphor film encapsulated between two dielectric films. A pixels is defined as the intersection point between a row and a column. Thus, FIG. 2 is a cross-sectional view trough the pixel at the intersection of ROW 4 and COL 4, in FIG. 1. Each pixel is illuminated by the application of a voltage across the intersection of row and column.

Matrix addressing entails applying a voltage below the threshold voltage to a row while simultaneously applying a modulation voltage of the opposite polarity to each column that bisects that row in two. The voltages on the row and the column are summed to give a total voltage in accordance with the illumination desired on the respective sub-pixels, thereby generating one line of the image. An alternate scheme is to apply the maximum sub-pixel voltage to the row and apply a modulation voltage of the same polarity to the columns. The magnitude of the modulation voltage is up to the difference between the maximum voltage and the threshold voltage to set the pixel voltages in accordance with the desired image. In either case, once each row is addressed, another row is addressed in a similar manner until all of the rows have been addressed. Rows which are not addressed are left at open circuit.

The sequential addressing of all rows constitutes a complete frame. Typically a new frame is addressed at least about 50 times per second to generate what appears to the human eye a flicker-free video image.

Typically the energy efficiency of such panels is fairly low as a result of the fact that each sub-pixel element has a relatively high electrical capacitance. When a range of voltages are simultaneously applied to the columns appropriate to address each row, the pixels on the remaining rows, which are electrically floating when they are not addressed, become partially charged. If there is a large number of rows, such as on a high resolution display, the ratio of energy expended in partially charging the non-addressed pixel as compared to the energy used to charge and activate the pixels on the addressed row can be quite large. Hence the overall energy efficiency of the display panel can be quite low, with a trend to lower efficiency as the resolution increases.

Minimizing the resistive loss associated with pixel charging can increase the energy efficiency of an electroluminescent display. This loss can be minimized by minimizing the peak charging current, and by minimizing the resistance of elements in the charging circuitry Generally, the former condition is realized when the pixels are charged at constant current. The energy efficiency can also be improved by a partial recovery of the stored capacitive energy in the pixels, but this is complicated by the fact the effective panel capacitance is strongly dependent on the extent of partial charging of the pixels on the non-addressed rows.

A variety of approaches have been used for improving the efficiency of electroluminescent displays. U.S. Pat. No. 4,847,609 teaches a technique for minimizing the power consumption of an electroluminescent display by a judicious choice of the thickness of the phosphor films and the capacitance of the dielectric layers used for the display. U.S. Pat. No. 5,856,813 teaches a system for reducing power consumption by maintaining the column voltage on certain rows in the event that the same column voltage is required on that row during successive frames. This scheme requires a complex feedback system that compares the image data for successive frames. U.S. Pat. No. 5,517,207 discloses the use of a three component driving voltage for an electroluminescent display whereby one of the voltage components is applied to all pixels to reduce the power dissipation in non-illuminated pixels. A more efficient display driver is set forth in U.S. patent application Ser. No. 09/504,472 wherein energy recovery is optimized and resistive losses are minimized. Although the above methods result in measurable improvement in operational efficiency of electroluminescent displays, further improvement is required before such displays are able to provide a competitive alternative to traditional CRT video display technology. The inventors have recognized that one area for deriving such an improvement is to reduce the relative energy loss associated with the non-addressed pixels.

SUMMARY OF THE INVENTION

An object of an aspect of the present invention is to provide an electroluminescent display and driving method therefor with increased luminance and energy efficiency and with a reduced number of address line drivers and simpler video digital processing circuitry relative to conventional prior art systems. This objective is accomplished in the present invention by dividing the rows of pixels into sub-pixel groups or sets and addressing several different sets of sub-pixels from within a larger set of adjacent sub-pixels.

The image data for the addressed sub-pixels is averaged with that for adjacent sub-pixels and is applied to the reduced number of larger sub-pixels in sequence. Consequently, for a given sequence of input frame data sets the time average over one frame for a portion of the sub-pixels at any location of the panel is substantially the same as that for a conventionally addressed sub-pixel in a prior art panel.

Alternatively, the present invention facilitates an increase in the apparent spatial resolution of a display having a defined number of pixels while maintaining its luminosity and energy efficiency using the method described above.

Other and further advantages and features of the invention will be apparent to those skilled in the art from the following detailed description thereof, taken in conjunction with the accompanying drawings introduced herein above.

DESCRIPTION OF THE PREFERRED EMBODIMENTS

Several embodiments of the invention are described herein, with the optimum choice of embodiment dependent upon display format and performance parameters, and in particular the trade off between power consumption, luminosity, the type of image to be displayed and image quality.

Preferably, the pixel sharing and multiple line scanning method of the present invention is optimized for use with a colour electroluminescent display having a thick film dielectric layer as discussed above with reference to FIGS. 1 and 2. Thick film electroluminescent displays differ from conventional thin film electroluminescent displays in that one of the two dielectric layers (see FIG. 2) comprises a thick film layer having a high dielectric constant. Although not shown in FIG. 2, the second dielectric layer can be made substantially thinner than the dielectric layers employed in thin film electroluminescent displays since the second dielectric layer is not required to withstand a dielectric breakdown (i.e. the thick layer provides this function). Wu et al (U.S. Pat. No. 5,432,015) teaches a method of constructing thick film dielectric layers for such displays.

As a result of the nature of the dielectric layers in thick film electroluminescent displays, The values in the equivalent circuit shown in FIG. 3 are substantially different than those for thin film electroluminescent displays. In particular, the values for $C_d$ can be significantly larger than they are for thin film electroluminescent displays. This makes the panel capacitance greater than it is for thin film displays as a function of the applied row and column voltages, and provides a greater impetus for the reduction of the relative power dissipated in non-addressed rows.

Example 1

Double Line Scanning Display

According to a special case of the present invention a double row or double line scanning method is provided whereby two adjacent rows of a display are addressed with the same data, thereby reducing the volume of video data needed to be addressed in one frame of video. By this means, the number of sequential addressing steps per frame required to address the display can be reduced and consequently the frame rate of the display can be increased. Since the luminosity of the display is approximately proportional to the frame rate, the luminosity of the display is approximately doubled.

Figure 4B:
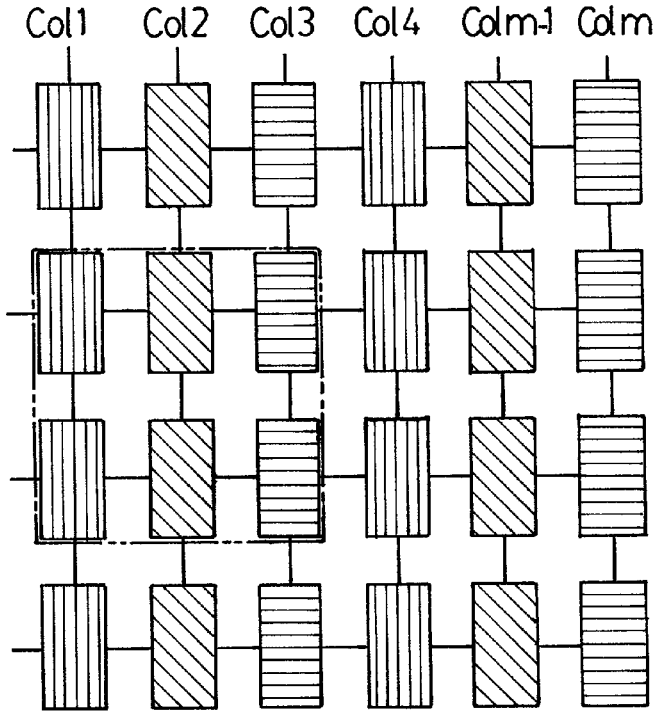

Double line scanning can be effected using one of two methods: progressive scanning and interlaced scanning. The progressive scanning method utilizes the same row pairs for every frame. It will be understood that double line progressive scanning results in a loss of resolution since, as indicated above, the volume of video data displayed with each frame of video is reduced. On the other hand, with interlaced double line scanning the pixels are alternately grouped into two different sets, referred to herein as odd sets and even sets. Even sets comprise line pairs starting from row 1 and row 2, row 3 and row 4, etc., until the final two rows (n−1) and n, as shown in FIG. 4*a*. Odd sets comprise pairs starting from row 2 and row 3, row 4 and row 5, etc., until (n−2) and (n−1), as shown in FIG. 4*b*. Row 1 an row n are not addressed in the odd frame which results in a loss of image data at the top and bottom of the display. However, this artifact can be overcome by adding two extra rows to the display.

Both progressive and interlaced scanning methods can be used on the same display with a simple change in the software addressing of the passive matrix. By way of contrast other display technologies utilize complex digital electronics to convert from progressive line scanning to interlaced scanning, and vice-versa. By eliminating the need fur such complex electronics, the line scanning methodology of the present invention results in simpler circuitry requiring fewer components than in the prior art. Thus, for a 480 line display operating at a frame rate which results in a field refresh rate of no less than 60 Hz, standard NTSC interlaced video can be viewed using double line scanning with no loss in video resolution (as compared to progressive line scanning). As indicated above, each 480 line frame of NTSC video is divided into an odd field and an even field. The video image is averaged by the viewer's eye for perception as a smooth looking video image with no apparent artifacts.

The increase in display energy efficiency inherent in the line scanning method of the present invention is illustrated by the following comparison between a conventional display using single line scanning and an otherwise identical display using the double line scanning method of the present invention. Because the energy efficiency is dependent on the nature of the displayed image, the comparison is made with two test patterns on a 320 by 240 pixel, 22 centimeter diagonal colour display. The first pattern was a white (red, green and blue sub-pixels illuminated with equal voltage) vertical bar occupying half of the screen, and the second pattern was a uniformly illuminated white screen.

For the purposes of this test, the display was constructed using a thick film dielectric according to the methods described in U.S. patent application Ser. No. 09/540,288 entitled EELECTROLUMINESCENT LAMINATE WITH PATTERNED PHOSPHOR STRUCTURE AND THICK FILM DIELECTRIC WITH IMPROVED DIELECTRIC PROPERTIES operated using a drive circuit incorporating the concepts described in U.S. patent application Ser. No. 09/504,472 entitled ENERGY EFFICIENT RESONANT SWITCHING ELECTROLUMINESCENT DISPLAY DRIVER and using Hitachi 2103 row and Supertex 629 column drivers. The threshold voltage for this display was 150 volts. The display was operated using a refresh rate of 240 Hz.

The efficiency is stated in terms of the ratio of the optical output measured in Lumens divided by the sum of the input electrical power to the rows and columns. The input power to the rows and columns was separately measured because the row power is dominated by the power consumed in the addressed rows, whereas there is a power draw on the columns from both the addressed rows and the non-addressed rows.

The luminance electrical power input into the columns and into the rows, and the overall energy efficiency for single line and for double line scanning with several different modulation voltages are set forth below in Tables 1 and 2 for each of the test image patterns. Also tabulated is the ratio of the energy efficiency for double line scanning to that for single line scanning.

TABLE 1

Comparative Energy Efficiency for Half Screen Bar Pattern

| Modulation Voltage (volts) | Scan Method | Luminance (cd/m2) | Row Power (watts) | Column Power (watts) | Efficiency (lumens/watt) | Efficiency Ratio |
|---|---|---|---|---|---|---|
| 30 | single | 12 | 8.1 | 10.8 | 0.62 | |
| 30 | double | 16 | 10.1 | 12.8 | 0.67 | 1.1 |
| 40 | single | 27 | 9.1 | 17.2 | 1.04 | |
| 40 | double | 38 | 12.2 | 18.5 | 1.24 | 1.2 |
| 50 | single | 43 | 11.0 | 24.2 | 1.23 | |
| 50 | double | 74 | 16.2 | 27.0 | 1.72 | 1.4 |
| 60 | single | 56 | 13.1 | 33.2 | 1.22 | |
| 60 | double | 102 | 20.0 | 37.0 | 1.78 | 1.5 |

TABLE 2

Comparative Energy Efficiency for Full Screen Illumination

| Modulation Voltage (volts) | Scan Method | Luminance (cd/m2) | Row Power (watts) | Column Power (watts) | Efficiency (lumens/watt) | Efficiency Ratio |
|---|---|---|---|---|---|---|
| 30 | single | 8 | 8.9 | 9.6 | 0.42 | |
| 30 | double | 8 | 11.2 | 10.6 | 0.34 | 0.8 |
| 40 | single | 25 | 12.3 | 12.9 | 1.00 | |
| 40 | double | 28 | 17.0 | 14.8 | 0.88 | 0.9 |
| 50 | single | 42 | 16.0 | 17.8 | 1.22 | |
| 50 | double | 56 | 22.4 | 20.8 | 1.29 | 1.1 |
| 60 | single | 56 | 19.9 | 24.7 | 1.26 | |
| 60 | double | 87 | 29.0 | 29.5 | 1.49 | 1.2 |

A simplified analysis of the relative energy efficiency for double row scanning as compared to single row scanning is as follows. If $P_x$ is the power dissipated in an addressed row, and $P_y$ is the power dissipated in a non-addressed row, then for single line scanning of a display with n rows the overall electrical to optical energy efficiency, $E_s$, for the display is given by $$E_s=\eta_p\eta_s P_x/(P_x+n\ P_y) \tag{1}$$

where $\eta_p$ is the electrical to optical energy conversion efficiency for an addressed row and $\eta_s$ is the efficiency of electrical power transfer to the panel under the load conditions for single line scanning. If double line scanning is used, the energy efficiency is given by $$E_J=2\eta_p\eta_d P_x/(2\ P_x+n\ P_y) \tag{2}$$

where $\eta_d$ is the efficiency of electrical power transfer to the panel under the load conditions for double line scanning and the other parameters are a previously defined. In the limit for high resolution displays, i.e. where $n\ P_y >> P_x$, these expressions simplify to $$E_s=\eta_p\eta_s P_x/n\ P_y \tag{3}$$

and $$E_d=2\eta_p\eta_d n\ P_y/n\ P_y \tag{4}$$

In view of the above equations, it can be seen that if $\eta_d>\eta_s/2$, the efficiency for double line scanning will be higher than for single line scanning. Of course, it should be noted that although $\eta_d$ will generally be less than $\eta_s$ due to higher loading of the drivers for double line scanning, the inequality above can be satisfied under many circumstances, particularly if the driver impedances are relatively low.

The data in Tables 1 and 2 can be understood in terms of the analysis above. The column power to the non-addressed rows is relatively low for the uniformly illuminated panel (Table 2). In this case, the voltage on all columns is the same, and the power dissipated in the non-addressed rows due to capacitive coupling with the columns is minimal. It should also be noted that the luminosity is not significantly higher for double line scanning, particularly for lower modulation voltages. This indicates a significant volume reduction at the pixels resulting from a voltage drop in the drivers due to an increased load for double line scanning. Correspondingly, the ratio of efficiencies for doable line scanning as compared to single line scanning is close to unity and in fact is somewhat less than unity for the lower modulation voltages.

By contrast, for the half screen bar pattern (Table 1), the power dissipation in the non-addressed rows is higher and this is reflected in the higher measured column power relative to the row power and in the higher ratio of the measured efficiency for double line scanning over single line scanning, despite an overall higher load on the row and column drivers and a corresponding reduction in the electrical power transfer efficiencies $\eta_s$ and $\eta_d$. The efficiency gains with double line scanning are greatest for the highest modulation voltage, since the relative power dissipation in non-addressed rows is largest in this case.

The test pattern of Table 2 is more representative of a typical video image and is therefore more illustrative of the energy efficiency improvements inherent in the double line scanning method of the present invention. It should be noted that the efficiency gains with double line scanning will be even higher than indicated above if lower impedance drivers are used.

Example 2

Shared Sub-pixel Design

Figure 5A:
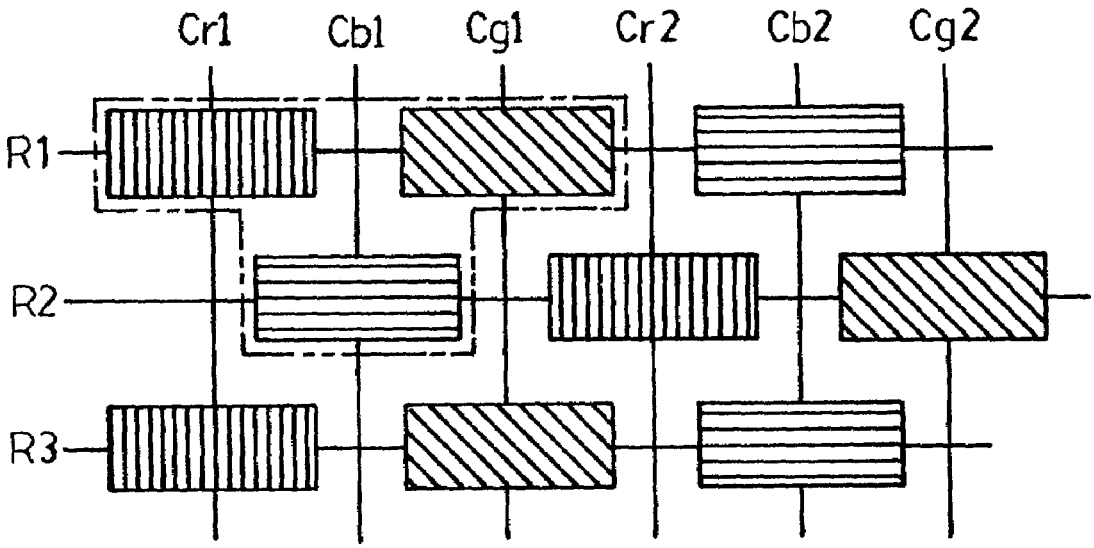
FIG. 5 comprises FIGS. 5*a–c* and is a schematic illustration of sub-frame pixel selections according to a second embodiment of the inventive pixel addressing method.
Figure 5B:
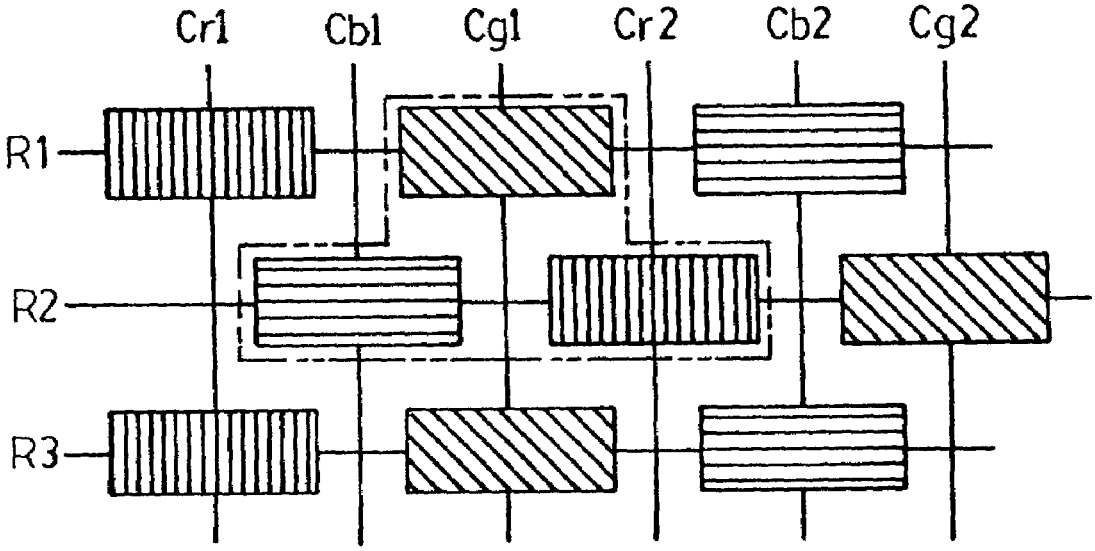
Figure 5C:
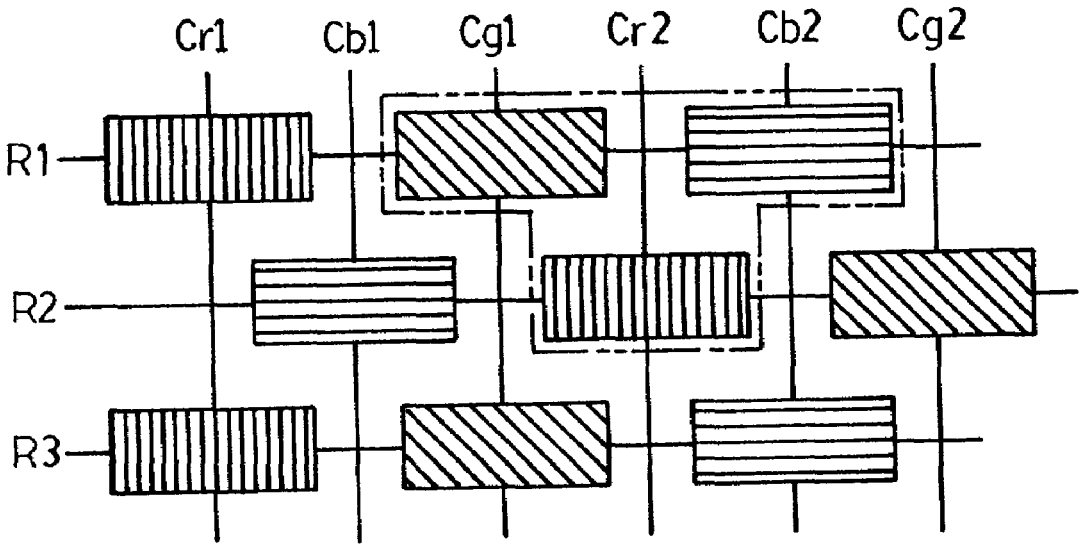
Figure 6A:
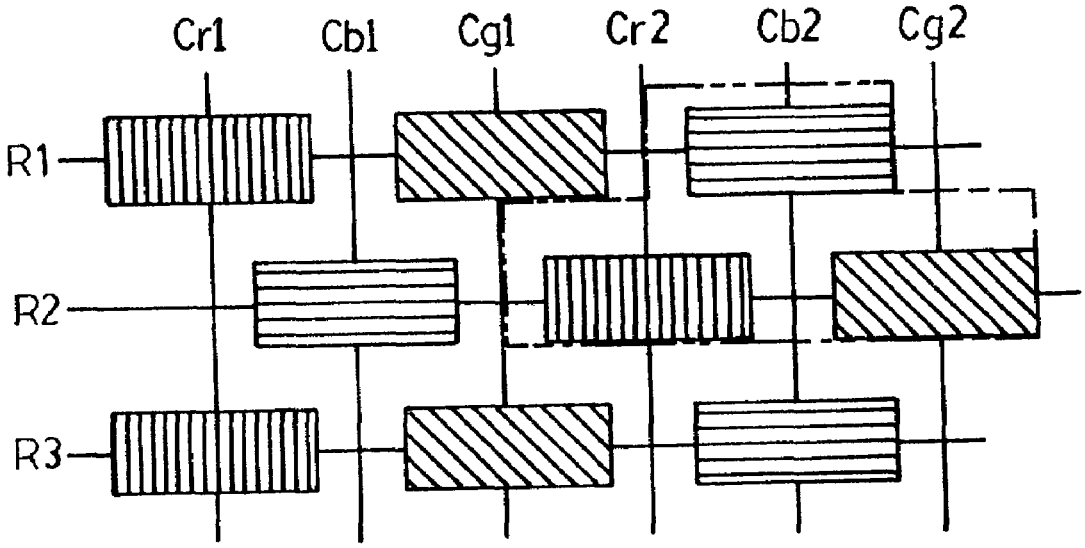
FIG. 6 comprises FIGS. 6*a–f* and is a schematic illustration of sub-frame pixel selections according to a third embodiment of the inventive pixel addressing method.
Figure 6B:
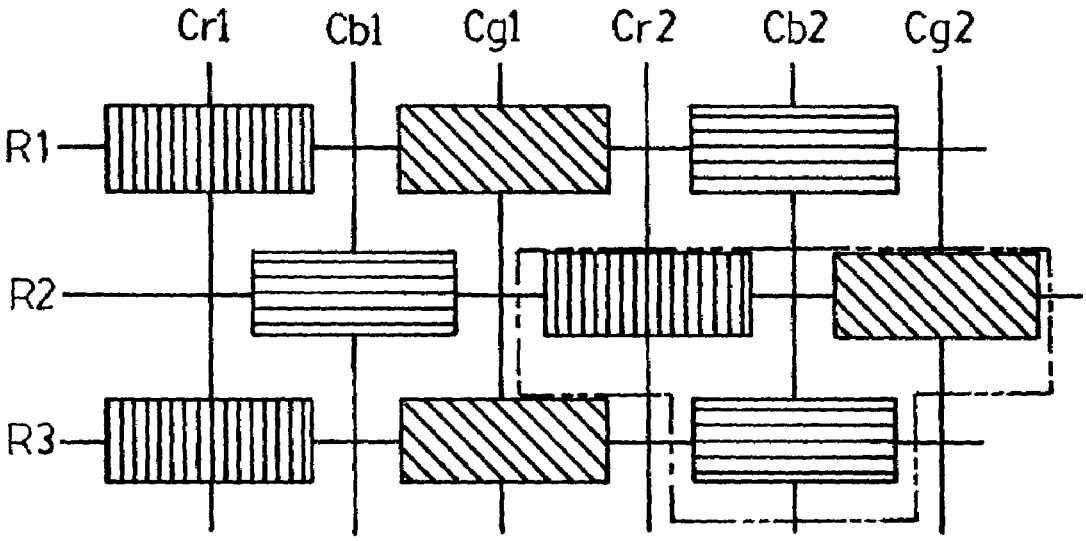
Figure 6C:
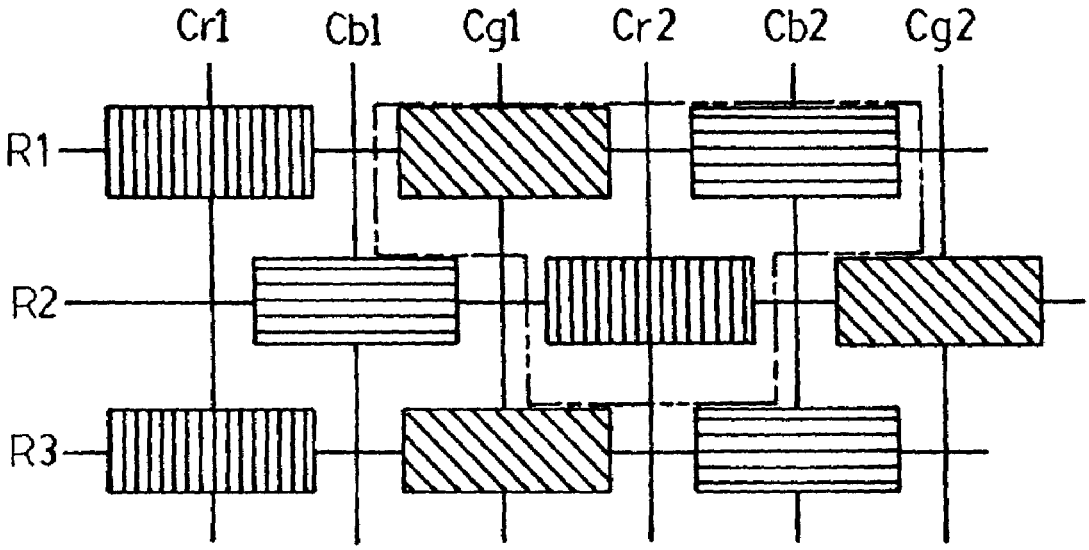
Figure 6D:
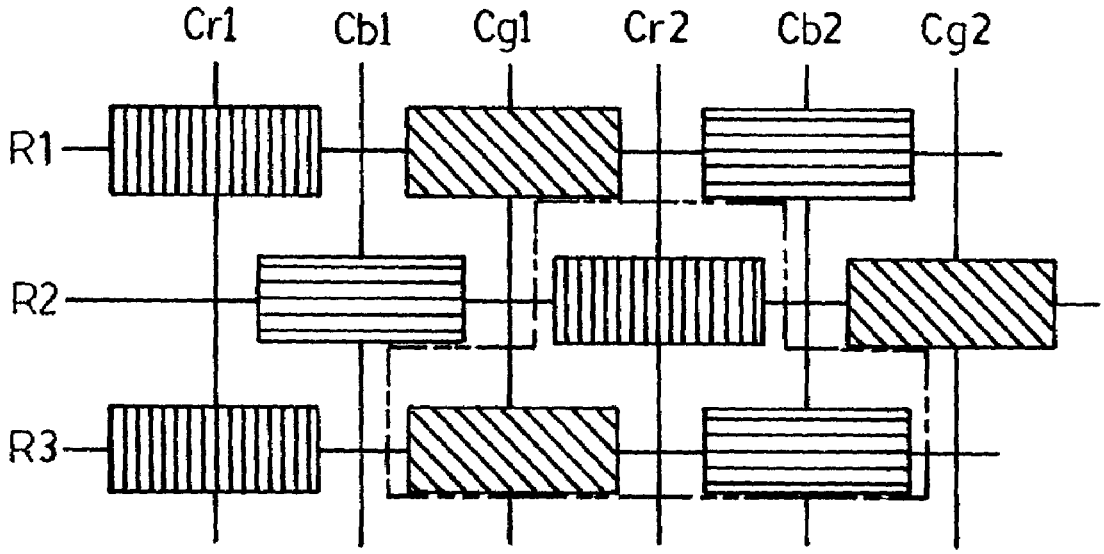
Figure 6E:
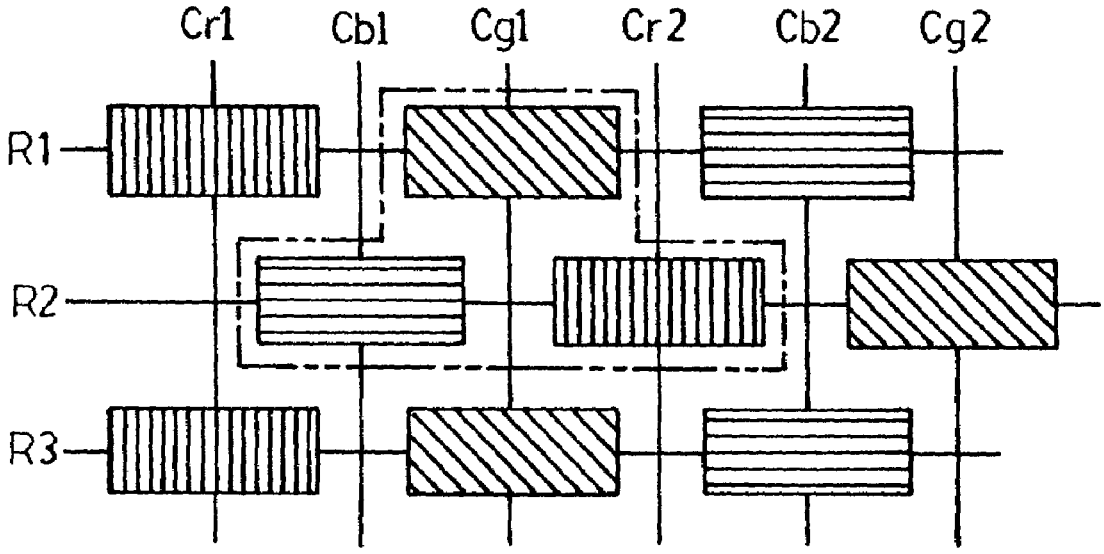
Figure 6F:
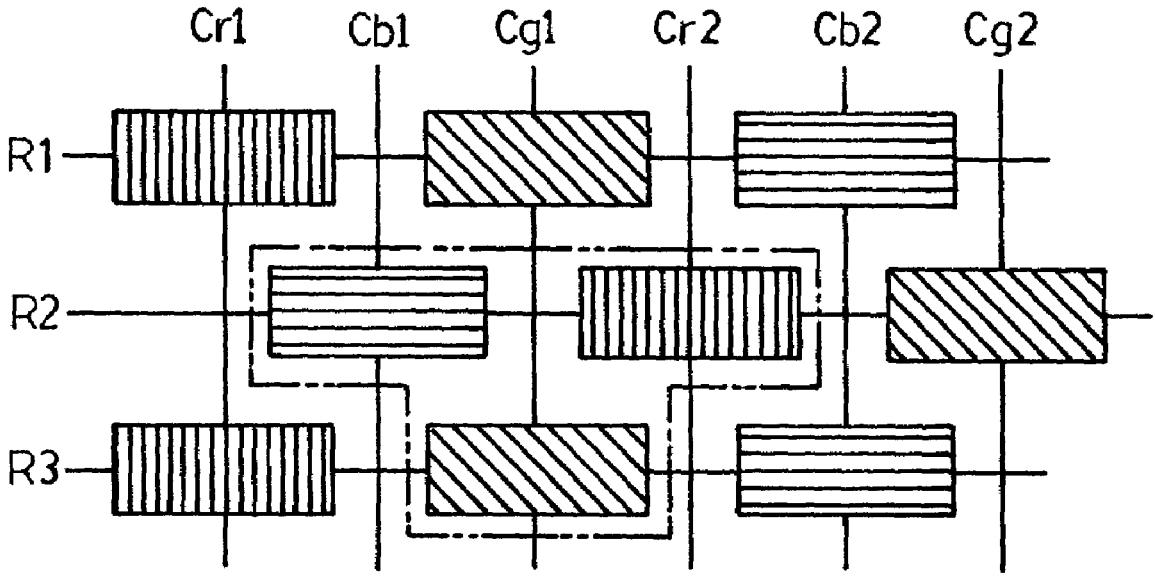

FIG. 5 illustrates a further embodiment of the invention wherein a triad pixel design is provided for a full colour display. According to this embodiment red, green and blue physical display pixels are selected or addressed as a triangular array of sub-pixels chosen from two adjacent rows of individual sub-pixels. In the illustrated embodiment, the number of physical display pixels in the superset from which sub-pixel sets are selected is five. The number of sub-pixels in a selected set is three (one red, one green and one blue sub-pixel), and the number of pixels of video data capable of being illustrated by each selected set is also three. A person of ordinary skill in the art may conceive of other operable configurations of triad pixel design.

The shared sub-pixel configuration of FIG. 5 is addressed using progressive scanning (i.e. pixel sharing among rows R1 and R2, followed by rows R3 and R4, etc.). Alternatively, as discussed in greater detail below with reference to FIG. 6, interlaced scanning maybe used (i.e. pixel sharing among rows R1 and R2, followed by rows R2 and R3, etc.). In order to achieve a frame rate of 50 to 60 Hz for the embodiment of FIG. 5, the pixel refresh rate must be three times that rate. The incoming video frame is split into three separate fields that are displayed sequentially. Thus, in the field the sub-pixel set defined by red (R1 Cr1), blue (R2 Cb1), green (R1 Cg1) is illuminated. In the second field the sub-pixel set defined by blue (R2 Cb1), green (R1 Cg1), red (R2 Cr2) is illuminated, and in the third field the sub-pixel set defined by green (R1 Cg1), red (R2 Cr2), blue (R1 Cb2), etc. is illuminated. When seen by the viewer, the eye optically averages the video frame that it appears to look like one frame of conventional video data.

According to the embodiment of FIG. 5, a reduction in the number of sub-pixels of 60% is achieved relative to the number of sub-pixels in a conventional passive matrix display. A similar reduction is achieved in the number of column drivers with the same apparent resolution, providing a substantial reduction in the cost of the display and any device in which the display is incorporated (e.g. a television product).

Example 3

Shared Sub Pixel Design with Double row Scanning

The two techniques described in Examples 1 and 2 can be combined as shown in FIG. 6 to yield improvements in luminance and energy efficiency of a flat panel display, as well as reduced cost. In this illustrated embodiment, the number of physical display pixels in the superset from which sub-pixel sets are selected is seven. The number of sub-pixels in a selected pixel set is three (one red, one green and one blue sub-pixel). As in the embodiment of FIG. 5, a shared triad pixel design is used with double line scanning. However, in the embodiment of FIG. 6, interlaced scanning is used instead of progressive scanning. The input video frame rate of 30 Hz for Standard NTSC video is split into six different fields: three even fields and three odd fields, which are sequentially displayed. As discussed above, these six fields are optically averaged by the viewer's eye to form one frame of NTSC data.

Although multiple specific embodiments of the invention have been described herein, it will be understood by those skilled in the art that variations may be made thereto without departing from the spirit of the invention or the scope of the appended claims.

What is claimed is:

1. In a method of driving a passive matrix electroluminescent display having a plurality of addressable rows and a plurality of columns to which successive frames of video data are applied and which intersect said rows to form a plurality of sub-pixels which when grouped together into sets form a pixel, the improvement comprising simultaneously addressing successive pairs of said rows for selecting distinct sets of a fixed number of said sub-pixels forming said pixel from a superset of said sub-pixels surrounding said pixel for each of a set of at least three sub-frames within a frame of said video data, wherein each of said distinct sets contains at least one common sub-pixel and is centered at spatial coordinates measured along said rows and columns that are different from spatial coordinates defining the center of at least one other said distinct sets, and applying video data to each of said sets of sub-pixels in such a manner that the time average of the video data over said frame of video data is in accordance with a video image to be displayed for said frame.

2. The improvement of claim 1 wherein three sets of three sub-pixels are arranged as sub-pixel triads spanning two rows selected from a superset of five adjacent sub-pixels.

3. The improvement of claim 2 wherein each set of three sub-pixels consists of a red, green and blue sub-pixel for a full colour display.

4. In a method of driving a passive matrix electroluminescent display having a plurality of addressable rows and a plurality of columns to which successive frames of video data is applied and which intersect said rows to form a plurality of sub-pixels which when grouped together into sets form a pixel, the improvement comprising simultaneously addressing successive pairs of said rows for selecting distinct sets of a fixed number of said sub-pixels forming said pixel from a superset of said sub-pixels surrounding said pixel for each of at least three sub-frames within a frame of said video data, and applying video data to each of said sets of sub-pixels in such a manner that the time average of the video data over said frame of video data is in accordance with a video image to be displayed for said frame, the improvement having six sets of three sub-pixels arranged as sub-pixel triads spanning two rows selected from a superset of seven adjacent sub-pixels spanning three rows wherein each set has a common sub-pixel centered at spatial coordinates measured along said rows and columns that are different from spatial coordinates defining the center of at least one other said distinct sets.

5. The improvement of claim 4 wherein each set of three sub-pixels consists of a red, green and blue sub-pixel for a full colour display.

* * * * *